US005429283A

United States Patent [19]

Lührsen et al.

[11] Patent Number: 5,429,283

[45] Date of Patent: Jul. 4, 1995

[54] IMMERSION NOZZLE FORMED OF SEPARATE MEMBERS

[75] Inventors: Ernst Lührsen, Bad Schwalbach; Siegfried Pohl, Heidenrod-Springen; Karl Baum; Erich Galle, both of Wiesbaden, all of Germany

[73] Assignee: Didier-Werke AG, Wiesbaden, Germany

[21] Appl. No.: 251,313

[22] Filed: May 31, 1994

[30] Foreign Application Priority Data

Jun. 23, 1993 [DE] Germany ..... 43 20 723.5

[51] Int. Cl.[6] ..... B22D 41/50

[52] U.S. Cl. ..... 222/606; 266/236; 222/607

[58] Field of Search ..... 266/236; 222/600, 606, 222/607, 591, 590

[56] References Cited

U.S. PATENT DOCUMENTS 5,173,242 12/1992 Lührsen et al. ..... 222/606
5,205,343 4/1993 Streubel et al. ..... 222/607
5,314,099 5/1994 Butz et al. ..... 222/606

FOREIGN PATENT DOCUMENTS 3709188 9/1988 Germany .
4024520 9/1992 Germany .

*Primary Examiner*—Scott Kastler
*Attorney, Agent, or Firm*—Wenderoth, Lind & Ponack

[57] ABSTRACT

An immersion nozzle is employed for discharging material from a vessel to a mold and includes an upper section to be connected to the vessel and a lower section having a region to be immersed in material in the mold. The upper and lower sections have extending therethrough respective discharge channels that communicate and that enable material to be discharged from the vessel to the mold. The discharge channel of the upper section converges downwardly in a first vertical plane to join the discharge channel of the lower section. The discharge channel of the upper section also expands downwardly in a second vertical plane transverse to the first vertical plane to join the discharge channel of the lower section. Each of the upper and lower sections is formed by at least one respective separate member. The members have adjacent ends having mutually facing and fitting surfaces, and each pair of facing and fitting end surfaces has therebetween a seal.

23 Claims, 2 Drawing Sheets

IMMERSION NOZZLE FORMED OF SEPARATE MEMBERS

BACKGROUND OF THE INVENTION

The present invention relates to an immersion or submerged nozzle, particularly for use in casting of thin slab articles, further particularly for such casting from molten metal. The present invention further relates to such a nozzle including an upper section to be attached to or mounted on a vessel, for example a metallurgical vessel, and a lower section having a region to be immersed or submerged in casting material within a mold. Further particularly, the present invention relates to such a nozzle wherein the upper and lower sections have extending therethrough respective discharge channels that communicate and enable material, particularly molten metal, to be discharged from the vessel to the mold, and wherein the discharge channel of the upper section tapers downwardly in a first vertical plane to join the discharge channel of the lower section, and the discharge channel of the upper section also expands or widens downwardly in a second vertical plane transverse to the first vertical plane to join the discharge channel of the lower section.

An immersion nozzle of the above general type is disclosed in DE 37 09 188 A1. Such nozzle is divided into separate longitudinal sections that may be made of different materials. Nevertheless however, the nozzle is constructed as a one-piece component. The manufacture of such nozzle is expensive, and when one section thereof becomes worn, the entire nozzle has to be replaced as an entire unit.

DE 40 24 520 C2, corresponding to U.S. Pat. No. 5,173,242, discloses a manner of connection between an outlet member of a metallurgical vessel and an immersion nozzle having a lower section to be immersed within molten material in a mold. At a region of a seat between the immersion nozzle and the outlet, a concentric annular chamber or channel is provided, with an inert gas feed pipe leading to such chamber. Compressible rings are positioned as sealing rings both above and below the annular chamber. The inert gas feed pipe has a pressure indicator to read the gas pressure within the annular chamber. If a leak occurs at one of the sealing rings, the pressure drops, and the indicator provides an indication of such pressure drop.

SUMMARY OF THE INVENTION

Accordingly, it is an object of the present invention to provide an immersion nozzle of the above general type, but whereby it is possible to overcome the above and other prior art disadvantages.

It is a further object of the present invention to provide such an immersion nozzle the manufacture of which is simplified and wherein individual sections of the overall nozzle can be replaced separately, without having to replace the entire nozzle when one of the sections becomes worn.

The above objects are achieved in accordance with the present invention by the provision that each of the upper section of the nozzle that is to be connected to the vessel and the lower section of the nozzle that includes a region to be immersed within material in a mold are formed of at least one respective separate member, for example separately shaped and configured refractory ceramic bricks. These members have adjacent ends that confront each other and that are fitted or interlocked, for example at mutually formed seats. A seal is disposed between each pair of fitted ends of respective pairs of members.

Since the immersion nozzle as a whole is assembled of at least two separate members, particularly refractory ceramic members, production of the overall immersion nozzle is simplified. Each of the members has a separate distinctive basic shape and configuration, and the discharge channel thereof has a separate and distinctive flow cross section that is advantageous to the particular member and particular length portion of the immersion nozzle as a whole. Additionally, each of the separately configured members may be made of a refractory ceramic material that corresponds to the unique thermal or melt-induced stresses to which that particular member is likely to be subjected. After a certain service life, only a particular member or members have to be replaced, and the remaining member or members of the overall nozzle can be reused. In other words, when only one member of a nozzle has been worn to a point that requires replacement, that particular member can be replaced without having to replace all of the members that still have remaining service life.

Even when adapting the immersion nozzle to different metallurgical vessels, from which the nozzle is intended to guide molten metal into molds of different geometrical configuration, the construction according to the present invention is particularly advantageous. Particularly, identically shaped members forming the upper section can be assembled with differently shaped members forming the bottom section, or vice versa. In this manner, it is possible to maintain a building kit or modular arrangement of differently shaped members. When requiring conveyance of material from a particular vessel to a particular mold, the various members to form the upper section and/or lower section for the particular immersion nozzle can be selected and assembled from the building kit or modular arrangement.

The seal provided between the fitting and facing ends of adjacent members prevent exterior air from penetrating into the interior of the nozzle. Additionally, such seal absorbs different degrees of thermal expansion of the separate members. Such different degrees of thermal expansion can result due to different coefficients of thermal expansion of the materials employed for the separate members and/or due to different temperatures to which the separate members are subjected. The seal also makes it possible to move the differently shaped members with respect to each other. In this manner it is easier to insert an immersion region into the mold. This particularly is true when the area to be immersed or inserted within the mold has a cross section closely adapted to the cross section of the mold. The seal preferably is formed by an annular chamber or channel in one of the confronting end surfaces of the adjacent members, with compressible sealing rings disposed axially above and below the chamber or channel. Such seal may be of the type disclosed in U.S. Pat. No. 5,173,242.

Since the shaped member or brick that forms the region of the lower section that is to be immersed or submerged within the mold is a separate member, it is possible to easily design such member to have longitudinal crosspieces extending across the overall discharge channel through such member, thus dividing the discharge channel into plural passages. This can have a good effect on the flow, particularly of molten metal, through such member into the mold.

The upper section of the immersion nozzle preferably is formed by separate top and center members, for example shaped refractory ceramic bricks. The top member preferably has a cylindrical or tubular passage therethrough, and the center member has therethrough a passage in the form of a flow shaft tapering, preferably converging or narrowing, downwardly in the first vertical plane and expanding or widening downwardly in the second vertical plane from the tubular passage of the top member. In this arrangement, the overall immersion nozzle is assembled of three separately shaped members, for example refractory ceramic bricks, that are sealed with respect to each other in the manner described above. The top shaped brick can be formed of a different refractory ceramic material than the center member that geometrically is more difficult and that forms the flow shaft that converges and expands.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
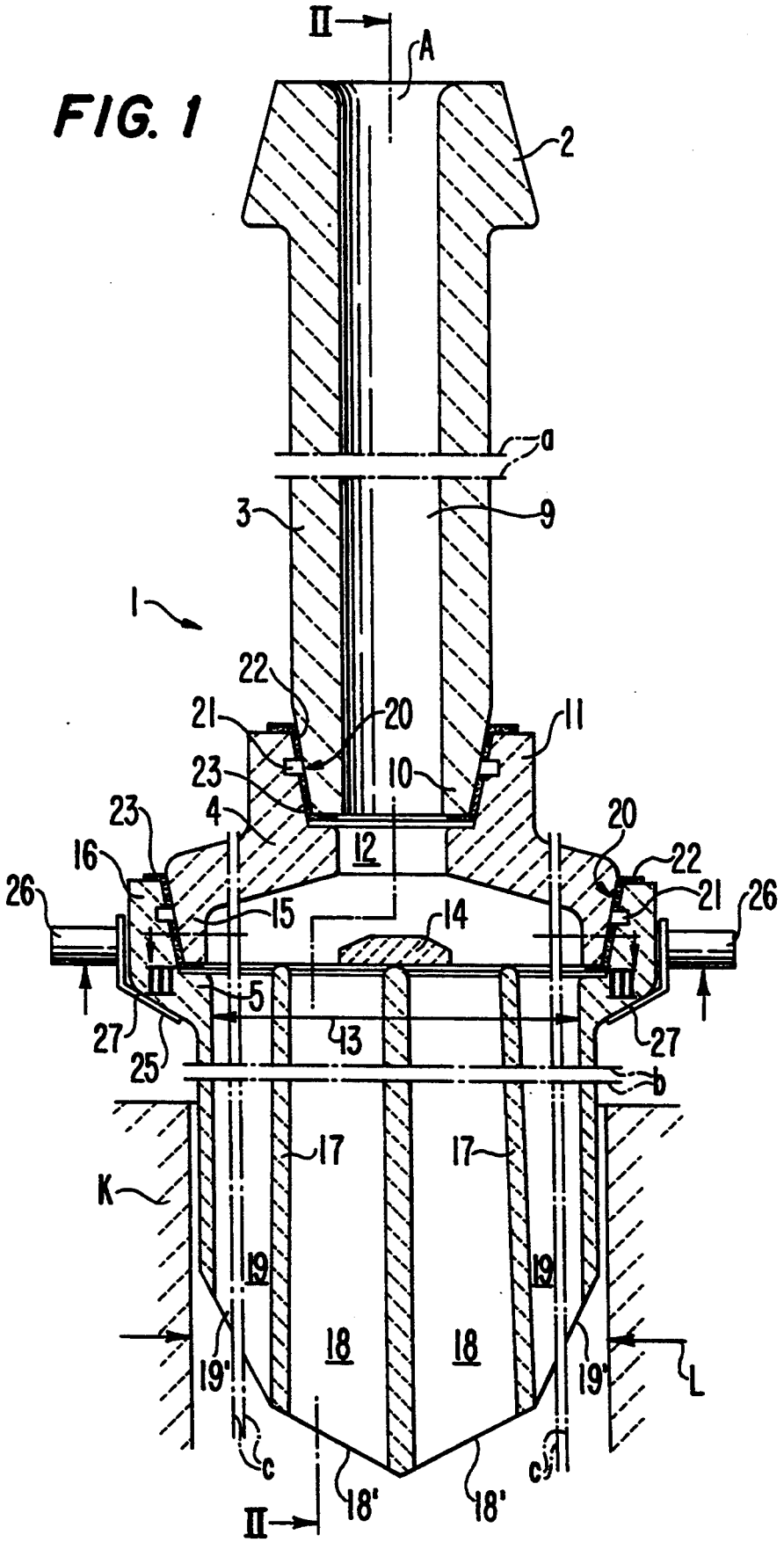
FIG. 1 is a longitudinal sectional view of a three-piece immersion nozzle in accordance with one embodiment of the present invention.
Figure 2:
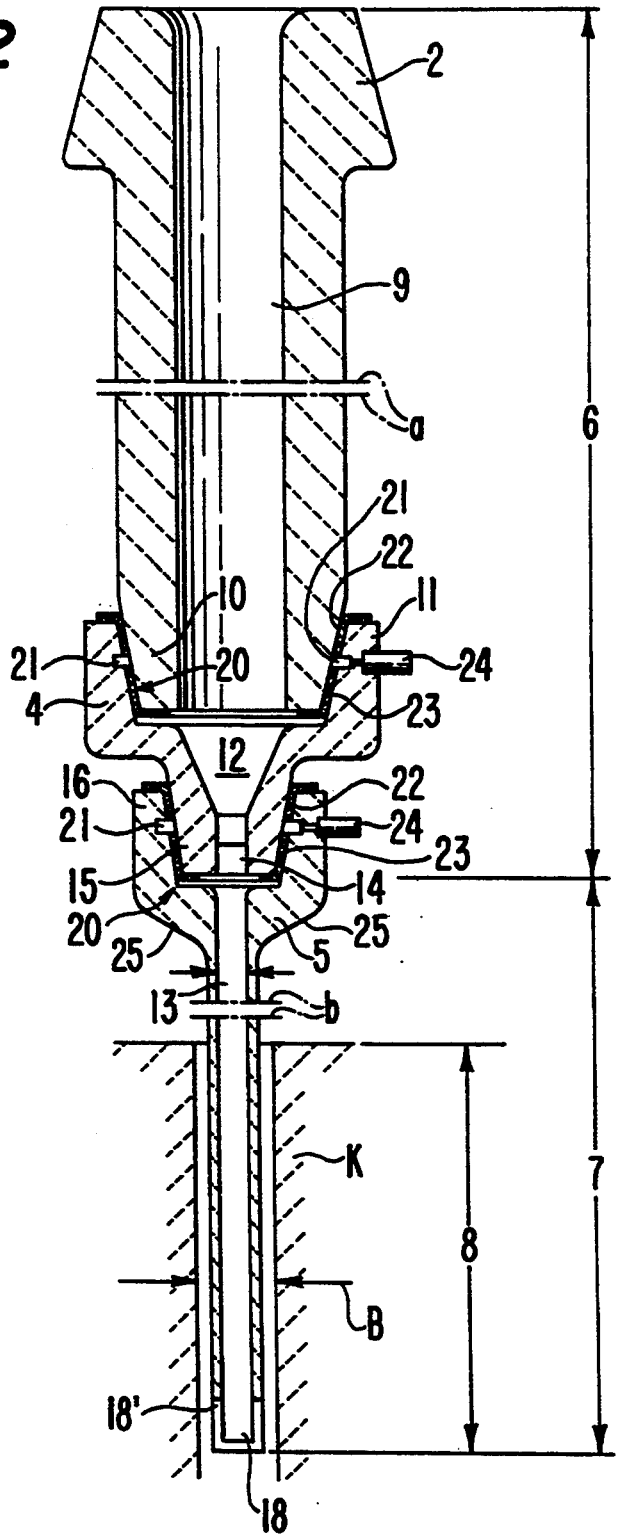
FIG. 2 is a longitudinal sectional view taken along lines II—II of FIG. 1.

Illustrated in FIGS. 1 and 2 is an immersion or submerged nozzle 1 formed of refractory ceramic material and including at the top thereof a flange 2 with which the nozzle is to be attached to a discharge of a metallurgical vessel (not shown) in a manner that generally in and of itself is known. In accordance with the present invention, the nozzle 1 is constructed of and assembled from three separately shaped brick members 3, 4, 5. Top member 3 and center member 4 form an upper section 6 of the nozzle 1 that is intended to be connected to the metallurgical vessel. Bottom member 5 forms a lower section 7 of nozzle 1 and includes a region 8 to be immersed or submerged within material, for example molten metal, within a mold K.

Bottom member 5 is dimensioned in such a manner that it generally tightly or closely occupies the width dimension B and the length dimension L of the internal cross sectional configuration of mold K, typical of a thin slab mold. Bottom member 5 correspondingly is shaped to be as thin walled as possible, at least in the immersed or submerged region 8. That is, the wall thickness in region 8 is thinner than other portions of the nozzle 1. This makes it possible for the material being discharged from bottom member 5 to be discharged as close as possible to the edges of the mold.

FIGS. 1 and 2 show by broken lines a, b graphic shortening of the heights of members 1 and 5. The actual heights of such members would be as is conventional in the art and as necessary for a particular nozzle application. FIG. 1 also shows by broken lines c graphic shortening of shaped members 4, 5 with respect to the length of the mold K.

Top brick 3 has therethrough a generally cylindrical discharge channel or passage 9 that forms an entry channel for molten metal from the metallurgical vessel. A bottom end 10 of top member 3 tapers conically downwardly and is inserted into an end 11 of center member 4 that expands conically upwardly. The tapered configurations of ends 10, 11 preferably are complementary.

Center member 4 has therethrough a discharge channel in the form of a flow shaft 12. Shaft 12 includes a first, upper portion that converges downwardly in a first vertical plane, i.e. the plane of FIG. 2 of the drawings, from cylindrical passage 9, and a second or lower portion that expands or widens downwardly in a second vertical plane, i.e. the plane of FIG. 1 of the drawings, from the first portion. Thus, the cross-sectional area of passage 9 is converted to the cross-sectional area of the passage or channel of bottom member 5, and this is done by flow shaft 12 converging and then expanding in the above manner. The internal configuration of flow shaft 12 could however be varied from that specifically illustrated, to still achieve the same basic purpose of converting the size or area of the configuration of passage 9 to the same or similar size or area of different configuration of the channel through bottom member 5. Flow shaft 12 thus has at the top thereof a configuration matching the configuration of passage 9, and flow shaft 12 has at the bottom thereof a configuration substantially matching that of the passage or channel through bottom member 5. Beneath entry channel 9, center member 4 has a cross piece 14 that deflects molten metal flow in the opposite directions of the expansion of flow shaft 12.

Center member 4 has a bottom end 15 that tapers inwardly downwardly and that fits into an end 16 of bottom member 5 that tapers inwardly downwardly. These tapers preferably are formed by respective complementary shaped surfaces. Thereby, there is formed a seat between ends 15, 16 just as there is formed a seat between confronting surfaces of ends 10, 11.

Bottom member 5 includes at least one, preferably several, longitudinal crosspieces 17 extending across the discharge channel through member 5, thereby dividing such discharge channel into plural passages. Crosspieces 17 may extend parallel to longitudinal axis A of nozzle 1 or extend somewhat obliquely thereto. Crosspieces 17 serve to stabilize bottom member 5 and/or to divide and orient the molten metal flowing through the cross section 13 of the discharge channel therethrough. Bottom member 5 thus has at the bottom end thereof that extends into mold K several exit openings 18, 19 defined by opening surfaces or rims 18', 19'. Rims 18', 19' are inclined with respect to the horizontal and with respect to axis A in order to improve flow into mold K. In so doing, rims 18' that are closer to the center of member 5 or to the longitudinal axis A have an inclination that is less steep than rims 19' that are spaced further from axis A. By such arrangement, uniform distribution of material, for example molten metal, into mold K is improved even if the bottom member 5 does not particularly approach or correspond to the length L of the mold K.

Figure 3:
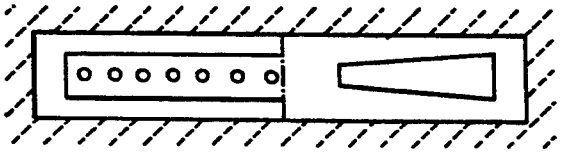
FIG. 3 is a transverse sectional view, generally taken along lines III—III of FIG. 1 and illustrating schematically different discharge cross sectional configurations of the region of the nozzle that is to be immersed within a mold.

FIG. 3 shows different cross sectional configurations of flow cross section 13 of bottom member 5. The flow channels or discharge passages formed through bottom member 5 can be circular or trapezoidal and/or can include different selected diameters. Other cross-sectional shapes also are possible.

A seal 20 is provided between end 10 and adjacent end 11, and a similar seal is provided between end 15 and adjacent end 16. Each seal may include an annular chamber or channel 21 formed in end 11 or 16 and a compressible sealing ring 22 inserted between the surfaces above the annular channel 21 and a further compressible sealing ring 23 inserted between the surfaces below the annular channel 21. Sealing rings 22, 23 can be formed of ceramic fiber material and also can be connected together. Gas lines 24 extend into respective annular channels 21 and are connected, for example, to pressurized inert gas. The inert gas pressure can be monitored by means of an indicator so that when a leak occurs in one of the seals, such leak can be detected as a function of pressure drop.

Center member 4 can be swiveled together with bottom member 5 around longitudinal axis A relative to top member 5. This is because confronting surfaces of adjacent ends 10, 11 are rotationally symmetrical, i.e. in the illustrated arrangement are conical.

Bottom member 5 has outwardly projecting portions or areas 25 above submerged region 8. A holding device 26, for example with brackets 27, can reach beneath areas 25. Thus, it is possible to hold together reliably during service or operation the three shaped members or bricks 3, 4, 5 of nozzle 1 without having to provide special connecting means therebetween that act in the axial direction in the region of ends 10, 11 and 15, 16. Holding device 26 also allows nozzle 1 to be inserted reliably into mold K, held therein and withdrawn therefrom. Furthermore, holding device 26 facilitates replacement of individual members 3, 4, 5 with replacement members.

Members 3–5, for example shaped refractory ceramic bricks, can be formed of different refractory materials particularly suited for the respective members. For example, upper member 5 can be formed of $Al_2O_3$—C and fabricated by an isostatic method. Center member 4 can be made of $Al_2O_3$ and can be fabricated by another method. Bottom member 5 can be made of $ZrO_2$.

Although the present invention has been described and illustrated with respect to preferred features thereof, it is to be understood that various changes and modifications may be made to the specifically described and illustrated features without departing from the scope of the present invention.

We claim:

1. An immersion nozzle for use in discharging material from a vessel to a mold, said nozzle comprising:

an upper section to be connected to a vessel;

a lower section having a region to be immersed in material in a mold;

said upper and lower sections having extending therethrough respective discharge channels that communicate and that enable material to be discharged from the vessel to the mold, said discharge channel of said upper section converging downwardly in a first vertical plane to join said discharge channel of said lower section, and said discharge channel of said upper section expanding downwardly in a second vertical plane transverse to said first vertical plane to join said discharge channel of said lower section;

each of said upper and lower sections being formed by at least one respective separate member;

said members being removably assembled with respective adjacent ends thereof having mutually facing and fitting surfaces; and each pair of said facing and fitting end surfaces having therebetween a seal.

2. A nozzle as claimed in claim 1, for discharging molten material, and wherein said members comprise refractory ceramic members.

3. A nozzle as claimed in claim 2, wherein said members are formed of different respective materials.

4. A nozzle as claimed in claim 1, wherein said fitting and facing end surfaces of said members comprise complementary tapered surfaces.

5. A nozzle as claimed in claim 1, wherein said upper section comprises separate top and center members.

6. A nozzle as claimed in claim 5, wherein said discharge channel of said upper section comprises respective communicating passages through said top and center members.

7. A nozzle as claimed in claim 6, wherein said passage of said top member is cylindrical, and said passage of said center member comprises a flow shaft converging downwardly in said first vertical plane and expanding downwardly in said second vertical plane from said cylindrical passage.

8. A nozzle as claimed in claim 7, wherein said flow shaft includes a first portion converging downwardly in said first vertical plane from said cylindrical passage, and a second portion expanding downwardly in said second vertical plane from said first portion.

9. A nozzle as claimed in claim 5, wherein said top and center members have complementary respective conical said end surfaces.

10. A nozzle as claimed in claim 9, wherein said top and center members are rotationally symmetrical along said conical end surfaces about a longitudinal axis.

11. A nozzle as claimed in claim 5, wherein said lower section comprises a bottom member fitted to said center member.

12. A nozzle as claimed in claim 11, wherein said center and bottom members have complementary respective tapered said end surfaces.

13. A nozzle as claimed in claim 1, wherein said lower section comprises a bottom member.

14. A nozzle as claimed in claim 13, wherein said discharge channel of said bottom member has a horizontal cross sectional configuration having a dimension in said first plane that is narrower than a dimension in said second plane.

15. A nozzle as claimed in claim 14, wherein said bottom member further includes at least one longitudinal crosspiece extending across said discharge channel in the direction of said dimension in said first plane and dividing said discharge channel into plural passages.

16. A nozzle as claimed in claim 15, comprising plural crosspieces.

17. A nozzle as claimed in claim 15, wherein said plural passages open downwardly from said bottom member at respective exit openings.

18. A nozzle as claimed in claim 17, wherein said bottom member has lower surfaces defining rim surfaces of said exit openings and inclined to the horizontal.

19. A nozzle as claimed in claim 14, wherein said bottom member has lower surfaces defining rim surfaces of said discharge channel and inclined to the horizontal.

20. A nozzle as claimed in claim 13, wherein said bottom member has outwardly projecting portions defining supports for a device to mount and retain said nozzle.

21. A nozzle as claimed in claim 1, wherein said seal comprises an annular channel formed in one said end surface, and compressible sealing rings positioned on opposite sides of said annular channel.

22. A nozzle as claimed in claim 18, wherein said plural passages include center and outer passages taken in said second plane, and said bottom member has rim surfaces of exit openings of said outer passages inclined at greater angles than rim surfaces of exit openings of said center passages.

23. A nozzle as claimed in claim 19, wherein said plural passages include center and outer passages taken in said second plane, and said bottom member has rim surfaces of exit openings of said outer passages inclined at greater angles than rim surfaces of exit openings of said center passages.

* * * * *